United States Patent [19]

Curry et al.

[11] Patent Number: 4,663,863

[45] Date of Patent: May 12, 1987

[54] DRYER OF THE TENTER TYPE

[76] Inventors: Donald P. Curry, 350 Preble St., S. Portland, Me. 04106; David R. LaCasse, 304 Spring St., Portland, Me. 04102

[21] Appl. No.: 780,620

[22] Filed: Sep. 26, 1985

[51] Int. Cl.[4] ..... F26B 21/06

[52] U.S. Cl. ..... 34/54; 34/155; 34/159; 34/62

[58] Field of Search ..... 34/47, 54, 155, 159, 34/161, 62, 66, 67

[56] References Cited

U.S. PATENT DOCUMENTS

| | | | |
|---|---|---|---|
| 1,601,966 | 10/1926 | Harris | 34/29 |
| 1,701,813 | 2/1929 | MacKay | 34/29 |
| 3,371,427 | 3/1968 | Thygeson | 34/155 |
| 3,403,454 | 10/1968 | Smith | 34/155 |
| 3,863,361 | 2/1975 | Gerhardt | 34/155 |
| 4,227,317 | 10/1980 | Fleissner | 34/155 |
| 4,231,167 | 11/1980 | Duris | 34/159 |
| 4,326,342 | 4/1982 | Schregenberger | 34/47 |
| 4,349,968 | 9/1982 | Escande | 34/47 |
| 4,481,722 | 11/1984 | Curry | 34/47 |

*Primary Examiner*—Albert J. Makay
*Assistant Examiner*—David W. Westphal

[57] ABSTRACT

A dryer of the tenter type has at least one air circulating unit consisting of a series of blowers drawing air from the drying chamber through a heater common to the series. The fans of the blower deliver reheated air back into the drying chamber in a manner such that each fan delivers air between a different pair of courses of the fabric travelling through the drying chamber. The blower which delivers drying air to the courses which include the exiting course is operable to deliver air thereto at a temperature lower than that established by the heater, a result attained by bypassing withdrawn air about the heater, by utilizing ambient air entering the dryer to make up for that lost by vapor withdrawal, or by combinations of bypassed and such make up air.

8 Claims, 4 Drawing Figures

10
11
12
13
14
15
16
17
18
19
20
21
23
24
25
26
27
28
29
30
31
32
33
34
35
F
2

10
11
13
14
15
17
18
19
20
21
22
23
24
25
26
27
30
31
34
3
F

DRYER OF THE TENTER TYPE

BACKGROUND OF THE INVENTION

A fabric is conventionally dried by continuously conveying a length through a drying chamber with the fabric supported in a manner providing a series of spaced and substantially parallel courses. Dryers of this type are commonly known as tenter dryers and each is provided with a first and second series of rollers, one series at each end of the chamber and arranged to enable a predetermined number of such courses to be established. Such dryers also have means to effect the advance of the fabric through the dryer at selected rates of travel and means to circulate the air through the chamber in direct contact with both surfaces of or through the fabric in adjacent courses and to heat the circulating air in a manner such that air withdrawn from the chamber is brought back to a selected temperature before again being forced back thereto. Among the advantages of such dryers is that they occupy relatively small areas as compared to that required for dryers of other types.

In the use of a dryer of the tenter type, a problem exists when a fabric, which term, as used throughout the application includes the finish thereof, may be damaged by air heated to a temperature to which other fabrics may be safely subjected. As long as free surface moisture is present to be evaporated from such a fabric, the temperature of the circulating air is not a problem. When the surfaces of the fabric dry as the fabric is advanced theough the chamber, the temperature of the fabric quickly responds to that of the circulating air so that in the exiting course or in a course or courses adjacent thereto, there is the certainty of damage to fabrics that cannot withstand such heating.

As the fabric in all courses are subject to air at approximately the same temperature, the drying of such fabrics has required that the temperature of the circulating air be reduced to an appropriate extent and also that the rate at which the fabric is passed through the chamber be reduced to an extent ensuring the drying of the fabric to the desired moisture content at the lowered temperature with the result that an objectionable but unavoidable time limitation is placed on production.

THE PRESENT INVENTION

The general objective of the present invention is to enable the temperature of the air to be delivered into the drying chamber and the rate of travel of the sheet through the chamber to be selected without regard to the fact that the sheet may be of a material or have a finish that, if dry, would be damaged by the selected temperature.

In accordance with the invention, this objective is attained by employing means to effect the delivery of air withdrawn from the chamber back into the chamber at a temperature less than the selected temperature in heat exchanging relationship with a course or courses which otherwise would be endangered if exposed to the selected drying temperature.

A tenter dryer may have, depending on its size, air circulating means at one end, at one side and spaced lengthwise of the drying chamber or air circulating means may be employed at both sides and spaced apart lengthwise of the drying chamber.

The air circulating means of a tenter dryer of the type with which the present invention is concerned consists of a plurality of blowers and a heater so positioned and dimensioned that each blower draws air from the drying chamber essentially through a different portion of the heater, which necessarily offer resistance to the flow of air through them. Each blower directs air through a delivery duct in heat exchanging contact with different courses of the sheet with the blower adjacent one end of the heater delivering air in heat exchanging contact with courses adjacent the exit from the chamber for the dried fabric.

In one embodiment of the invention, the desired control of the temperature of the air delivered to any otherwise endangered course is effected by means of a damper controlled, heater bypass so located relative to said one end of the heater that the air delivered into the chamber by the blower adjacent that end is primarily bypassed air withdrawn from the chamber and at a temperature substantially less than the selected temperature.

Another objective of the invention is to enable the amount of bypassed air to be increased, an objective attained by providing a face damper unit at the intake side or face of the heater dimensioned to ensure the blockage of air through the heater to said one heater.

Yet another objective of the invention is to enable the percentage of bypassed air to be further varied, up to 100% if desired, by means of a face damper unit or units operable to further limit or completely block air flow therethrough.

Another objective of the invention is to enable the air delivered to an endangered course or courses to be at a temperature less than that withdrawn from the chamber, an objective attained by mixing make up air with bypassed air or, with the bypass damper and, if desired, an adjacent face damper closed, employing only makeup air for delivery to any endangered course.

Other objectives and the manner of their attainment will be apparent from the following description of preferred embodiments and the appended claims.

BRIEF DESCRIPTION OF THE DRAWINGS

The accompanying drawings illustrate preferred embodiments of the invention of which

THE PREFERRED EMBODIMENT OF THE INVENTION

Figure 1:
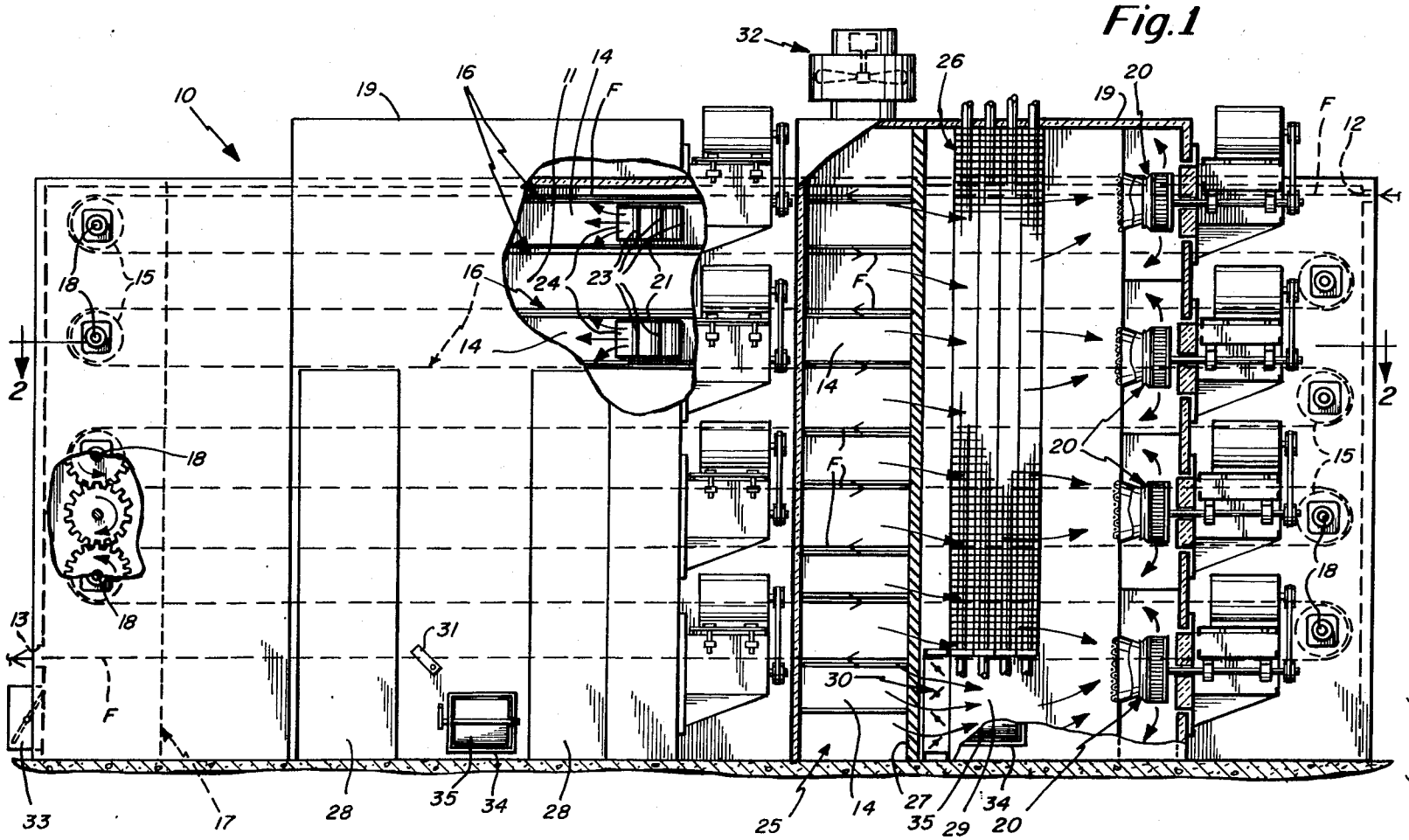
FIG. 1 is a partly sectioned side view of a fabric dryer of the tenter type in accordance with the invention.
Figure 2:
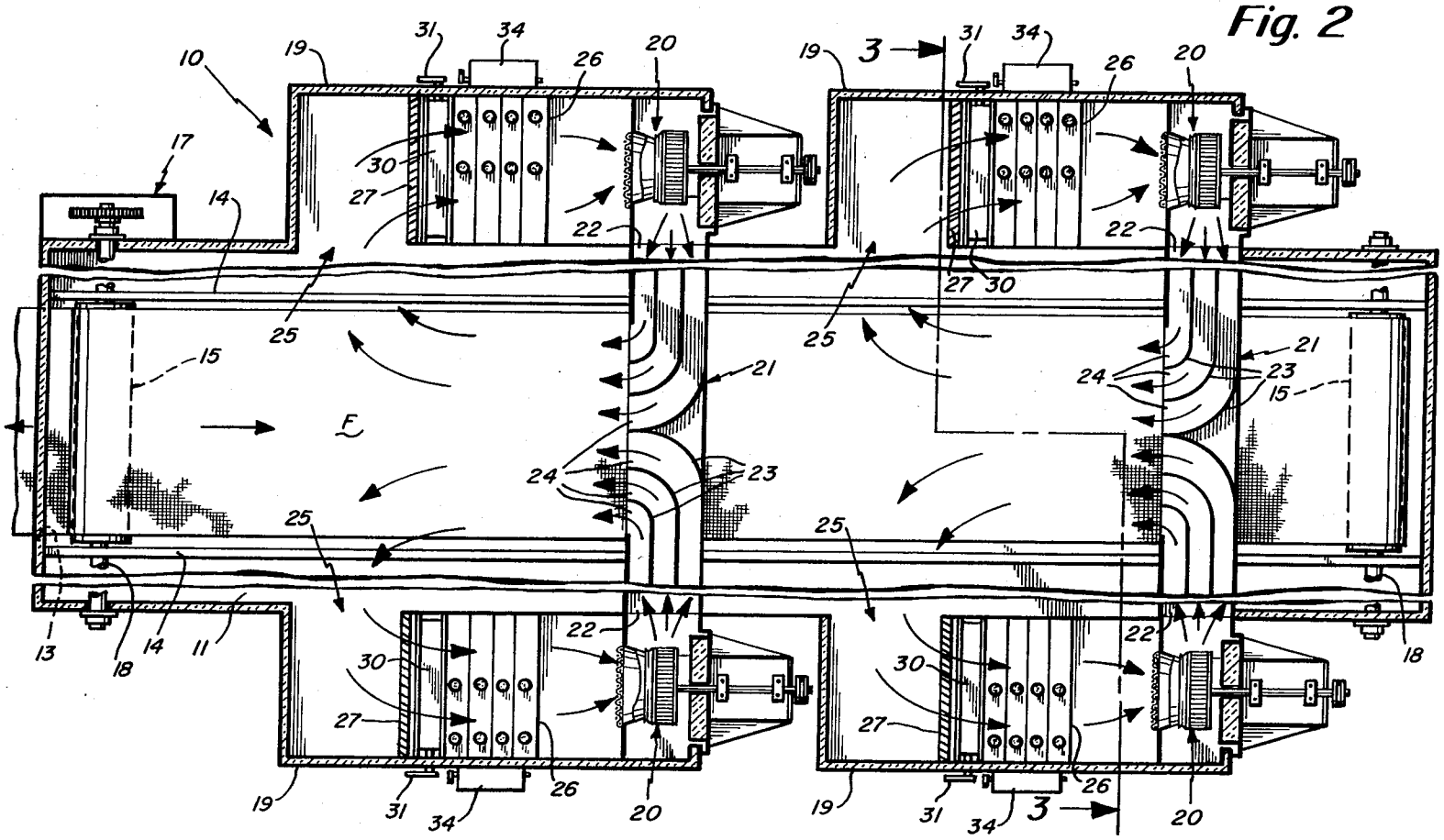
FIG. 2 is a section taken approximately along the indicated line 2—2 of FIG. 1.
Figure 3:
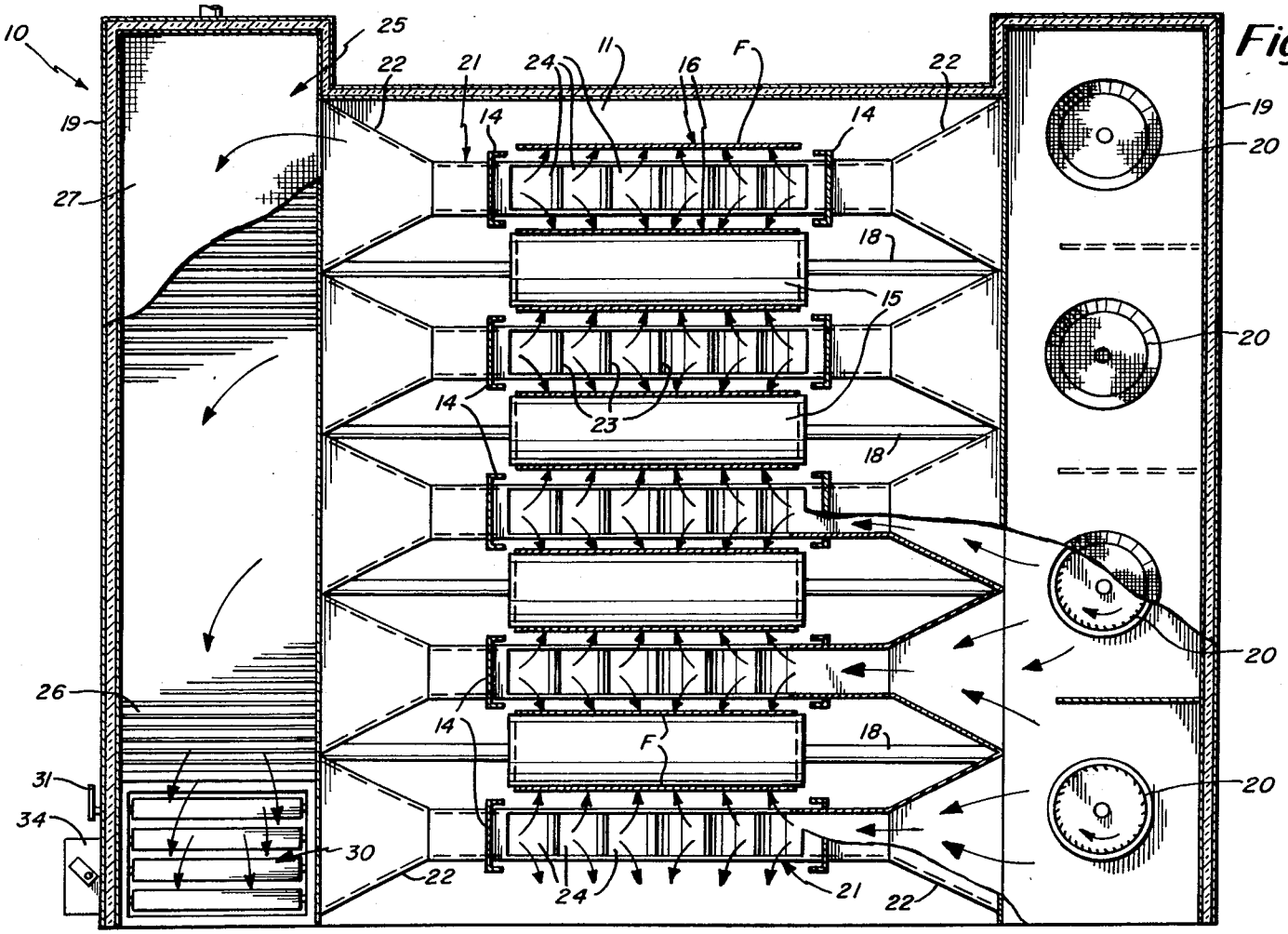
FIG. 3 is a section taken approximately along the indicated line 3—3 of FIG. 2.

The dryer illustrated by FIGS. 1-3 is generally indicated at 10 and has a lengthwise drying chamber 11 having an infeed port 12 for fabric F adjacent the top of its right hand or front end wall of the chamber and an outfeed port 13 adjacent the bottom of its left hand or rear wall.

A vertically spaced series of transversely aligned beams 14 extending from end to end of the chamber 11 are supported by the end walls thereof. There is a vertically spaced series of transverse rollers 15 adjacent each end wall of the chamber 11 with the series adjacent the rear wall between each two transversely aligned beams and those of the other series between vertically spaced pairs of beams 14 to provide a roller arrangement such that the fabric F may be trained about them in a manner providing vertically spaced pairs of fabric courses, generally indicated at 16. Each such pair of courses 16 opens towards the front of the chamber 11 and is closed by the appropriate one of the rollers 15 of the series adjacent the rear wall of the chamber 11.

The drive by which the fabric F is advanced through the dryer is operable to effect such travel at selected rates. Such drives are conventional for tenter dryers and are not detailed other than to note that the rollers 15 adjacent the rear walls of the chamber 11 are all driven in the same direction by a gear train within a housing 17 interconnecting their shafts 18.

The dryer 10 has a first and a second pair of transversely aligned housings 19 spaced lengthwise of the sides of the chamber 11 in each of which there is a vertically spaced series of blowers, generally indicated at 20, supported by its front wall. The chamber 11 is provided with a vertically spaced series of transverse ducts 21, between each pair of housings 19 with one duct 21 within each pair of fabric courses 16 and having funnel shaped ends 22 opening into the proximate housings 19. The end portions are dimensioned and disposed to effect the delivery of air from the blowers 20 into the ducts 21 with minimum turbulence.

Each duct 21, see FIG. 2, is subdivided by vertical partitions 23 extending from each housing and dividing the duct into right and left hand sections. The proximate ends of the partition 23 are rearwardly curved and provide a horizontal series of outlets 24 so that the blowers 20 of each housing 19 deliver air lengthwise of the pairs of courses.

Each housing 19 has a rearward opening 25 into the chamber 11 in a zone spaced rearwardly of the duct outlets 24 a distance such that the delivered air is in drying contact with substantial lengths of the courses.

The fans of the blowers 20 of each housing 19 draw air from such a zone through a heater 26, shown as of the type having steam heated coils. The intake side or face of each heater 26 is protected by a screen 27 and each housing 19 has access doors 28, one on each side of its heater 26.

The temperature at which the heaters 26 are to operate is adjustable and it and the rate of travel of the fabric through the dryer are selected to effect the drying of the fabric to the wanted moisture content without injury thereto in the shortest time possible. Prior to the present invention, whenever it has been necessary to protect the fabric against being heat damaged by lowering that temperature of the drying air, it has also been necessary to reduce the rate of travel of the fabric through the dryer.

In accordance with the invention, the heaters 26 are shown as not extending to the floors of the housing 19, see FIG. 1, although the lower end portions thereof are in a position such that air will be drawn therethrough by the lowermost blowers 20. The space 29 below each heater 26 is a heater bypass closed by a damper unit 30 if the fabric when its moisture content has been reduced to the desired level, can withstand the temperature to which the circulating air is heated.

Should the circulating air be at a temperature such that the fabric, when free water has been evaporated therefrom, would be damaged thereby, the damper units 30 are opened by means of the adjusting levers 31 to the wanted extent. Since the path of least resistance to air flow is now through the bypasses 29, air withdrawn by the lowermost blowers 20 is delivered to the lowermost pair 16 of fabric courses essentially at the temperature at which the air was withdrawn from the chamber 11 which is assumed to be that which will not injure the fabric in those courses.

It will be noted that dryers have to provide for the withdrawal of moisture from their chambers. This is conventionally effected by providing exhaust fans 32 and also damper controlled ports 33 for make-up air to offset the resulting loss.

In addition, the housings 19 are shown as having a damper controlled air make up port 34 opening into each of them between its heater and the lowermost blower 20 and provided with a damper 35 so that the temperature of air, bypassing the heater 26 may be further reduced or, alternatively, each port 34 may be employed with the associated bypass damper unit 30 also closed to enable only ambient air to be delivered to a course or courses that would otherwise be endangered, or the damper units may both be partly opened.

Figure 4:
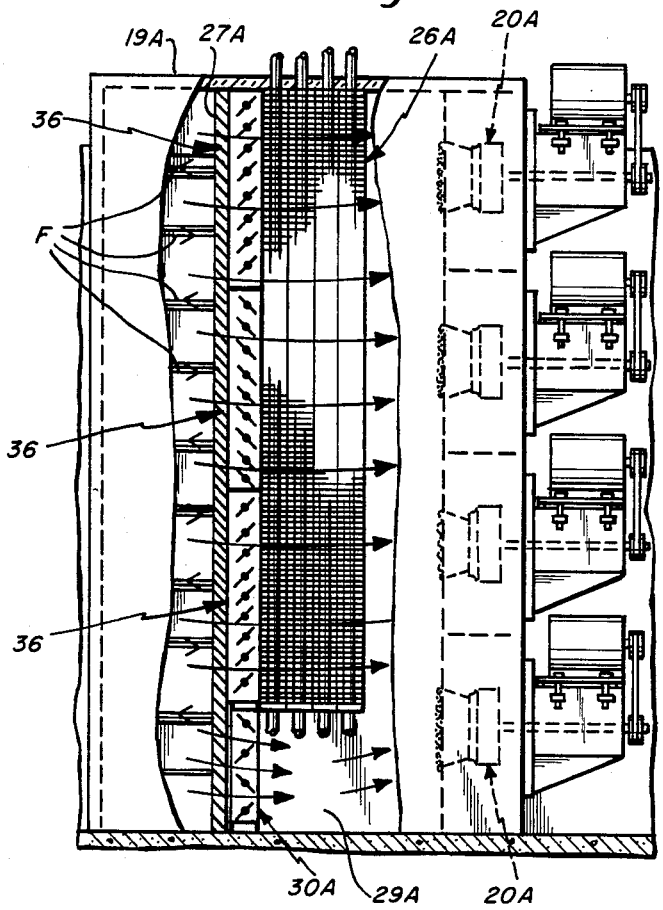
FIG. 4 is a fragmentary side view of a dryer with a blower and heater housing partly sectioned and illustrating another embodiment of the invention.

The embodiment of the invention illustrated by FIG. 4 is generally similar and corresponding parts will not again be described but are identified by the same reference numerals which are distinguished by the suffix addition "A".

In FIG. 4, the intake side of the heaters 26A are under the control of a series of face damper units 36. Unlike the bypass damper units 30, the damper units 36 are normally open and are adjusted towards their closed positions to increase bypass flow, decrease air flow to one or more of the upper blowers 20A or block such flow thus to enable air at a high temperature to be used only where and when such high temperatures can be tolerated by the fabric.

It will, accordingly, be appreciated that since the fabric is subject to drying temperatures that would otherwise endanger the fabric before it leaves the chamber 11, the invention permits both the temperature of the heaters and the rate of travel of the fabric to be unchanged.

I claim:

1. A dryer for a length of a wet sheet, said dryer having a chamber through which the sheet is to pass from the infeed of the chamber through the outfeed thereof and have free moisture evaporated therefrom while passing therethrough, rollers within said chamber arranged to support the sheet in a manner establishing a series of spaced, substantially parallel courses thereof, means to effect the continuous advance of the sheet through the chamber at a selected rate, at least one unit operable to circulate heated air through said chamber, said unit including a series of blowers and delivery conduits such that one delivery conduit is provided for each blower and each conduit is operable to receive air from the blower, said delivery conduits extending into said chamber and so disposed relative to each other and to said courses that said blowers deliver air in heat exchanging contact with different courses, said unit being in communication with said chamber in a zone such that air delivered by said conduits is in heat exchanging contact with substantial lengths of said courses of the wet sheet before it is withdrawn from the zone, the dryer further comprises a heater common to said series of blowers through which air from said zone is withdrawn by said blowers then to be recirculated thereby and by which the temperature of the delivered air is maintained at a temperature selected for drying said material, the temperature being uniform with respect to all of said blowers, and said unit provided with means operable to effect the delivery of air at a reduced temperature by at least one blower circulating air through that portion of the chamber adjacent the outfeed thereof when a course of the material in that portion would be endangered by the selected temperature, said last named means including a port adjacent but spaced from said heater and provided with a damper and operable, when said damper is opened, to admit air which is unaffected by said heater to the intake of said one blower.

2. The dryer of claim 1 in which the port of the temperature moderating means is a conduit for air withdrawn from the chamber which bypasses the heater.

3. The dryer of claim 2 in which there is at least one damper unit at the intake face of the heater and positioned to block the flow of air through at least that portion of the heater adjacent the bypass conduit.

4. The dryer of claim 2 in which the conduit also has a port for ambient air adjacent said one blower and provided with a damper.

5. The dryer of claim 1 in which each blower draws air primarily through a different portion of the heater, the said one blower is adjacent one end of the heater, and the port is a passageway below said one heater.

6. The dryer of claim 5 and a damper unit at the intake face of the heater so positioned that when closed air flow to the said one blower is blocked thereby.

7. The dryer of claim 5 and a series of damper units at the intake face side of the heater so positioned and arranged as to enable air flow through the heater to be blocked relative to any or all of the blowers.

8. The dryer of claim 1 in which the port is for ambient air adjacent said one blower and provided with a damper.

* * * * *